US011519685B1

(12) United States Patent
Edminster et al.

(10) Patent No.: US 11,519,685 B1
(45) Date of Patent: Dec. 6, 2022

(54) METHOD OF REPAIRING A FIREARM NOISE SUPPRESSOR

(71) Applicant: Summit Sound Technologies LLC, Austin, TX (US)

(72) Inventors: Karl R. Edminster, Fairhaven, MA (US); Stephen A. Piche, Raynham, MA (US)

(73) Assignee: Summit Sound Technologies LLC, Austin, TX (US)

( * ) Notice: Subject to any disclaimer, the term of this patent is extended or adjusted under 35 U.S.C. 154(b) by 0 days.

(21) Appl. No.: 17/658,456

(22) Filed: Apr. 8, 2022

Related U.S. Application Data

(62) Division of application No. 16/352,399, filed on Mar. 13, 2019, now Pat. No. 11,326,849.

(60) Provisional application No. 62/664,961, filed on May 1, 2018.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 3,667,570 A 6/1972 WerBell, III
5,279,200 A 1/1994 Rose
5,425,299 A 6/1995 Teetzel
5,698,810 A 12/1997 Rose
5,860,242 A 1/1999 O'Neil
6,425,310 B1 7/2002 Champion
7,895,877 B1 * 3/2011 Moreland ..... F41A 21/22 72/454
8,015,908 B2 9/2011 Kline et al.
8,091,462 B2 1/2012 Dueck
8,201,487 B2 6/2012 Dueck et al.
8,210,087 B2 7/2012 Latka
9,513,078 B1 12/2016 Fulton
9,677,839 B1 * 6/2017 Phoenix ..... F41A 21/30
9,702,651 B2 7/2017 Petersen
9,835,399 B1 * 12/2017 Lessard ..... F41A 21/30
9,921,020 B2 3/2018 Latka
10,119,779 B1 11/2018 Miele
10,126,084 B1 11/2018 Oglesby
(Continued)

OTHER PUBLICATIONS

The Firearm Blog (TFB) ATF NFA Marking Requirements: Get. It. Right. (Posted Jun. 6, 2016) (Year: 2016).

*Primary Examiner* — Michelle Clement
(74) *Attorney, Agent, or Firm* — Wood Herron & Evans LLP

(57) ABSTRACT

Provided is a method of repairing a firearm noise suppressor that includes a baffle chamber unit and a removable identification band with identifying indicia thereon with material of an area of the band is affixed to the baffle chamber unit to prevent the removal of the band without a machining process to the selected area. The method includes machining the affixed area of the band to remove the affixed material, removing the band from the baffle chamber unit, repairing or preplacing the baffle chamber unit, reinstalling the band on the baffle chamber unit, and affixing a different area of the band to the baffle chamber unit to prevent the removal of the band without a machining process.

6 Claims, 5 Drawing Sheets

(56) References Cited

U.S. PATENT DOCUMENTS

| | | | | |
|---|---|---|---|---|
| 10,345,070 | B1 * | 7/2019 | Lepka | F41A 21/30 |
| 10,451,374 | B2 | 10/2019 | Palu | |
| 10,488,139 | B1 | 11/2019 | Graham, II | |
| 10,663,246 | B1 | 5/2020 | Gelemter | |
| 11,326,849 | B2 | 5/2022 | Edminster et al. | |
| 2002/0117048 | A1 | 8/2002 | Sevastian | |
| 2012/0180624 | A1 | 7/2012 | Troy | |
| 2016/0018177 | A1 * | 1/2016 | Powell | F41A 21/30 89/14.4 |
| 2016/0061551 | A1 | 3/2016 | Petersen | |
| 2017/0350669 | A1 | 12/2017 | Latka | |
| 2019/0339036 | A1 | 11/2019 | Edminster | |
| 2019/0353446 | A1 | 11/2019 | Kras | |
| 2020/0149836 | A1 | 5/2020 | DeJessa | |

* cited by examiner

METHOD OF REPAIRING A FIREARM NOISE SUPPRESSOR

RELATED APPLICATIONS

This application is a divisional of U.S. Nonprovisional patent application Ser. No. 16/352,399, filed Mar. 13, 2019, which claims the benefit of priority to U.S. Provisional Patent Application No. 62/664,961, filed on May 1, 2018, the disclosures of which are incorporated by reference herein.

TECHNICAL FIELD

This invention relates to firearm noise suppressors, also known as silencers. More particularly, it relates to a way of repairing such a device that makes repairs easier under the constraints of U.S. laws regulating firearm noise suppressors.

BACKGROUND

The function and general structure of firearm noise suppressors are well known. Typically, it includes a housing attached to a muzzle of a firearm barrel with the interior divided into chambers with a projectile passageway that axially aligns with the bore of the firearm barrel.

A traditional way of constructing a suppressor has been to use a tubular housing into which baffles are inserted and end caps are attached. Some designs weld together a core of baffles or mill chambers into a solid piece of material to create a monolithic baffle core. Others have made "modular" baffle units that create the outer walls of the chambers when the units are threaded together. More recently, others have circumferentially welded together a series of baffles have been in a way that creates an integral housing such that an outer tube is unnecessary. The latter example provides a unit with minimum weight, because it eliminates both the outer tube and the material required to make the threaded connections sufficient to withstand internal pressure.

Under federal laws and regulations in the United States, suppressors must be permanently marked with a serial number and other identifying information. Typically, this is done by engraving the information on the tubular housing. For suppressors constructed from a unified stack of baffles without an exterior tube, the identifying information is engraved on the exterior of the unified baffle stack.

Damage may occur to a suppressor during use, the most common example of which is a projectile striking an internal baffle. Because of legal restrictions, a damaged suppressor must be returned to the manufacturer for repair and the marking may not be altered or re-marked onto new parts. If the damaged suppressor is constructed with a tubular housing engraved with the required identifying information, individual baffles or a baffle core may be replaced. However, if the part that is engraved with identifying information is irreparably damaged, the entire device must be replaced. In designs where a stack of baffles has been welded together without a separate tubular housing, repair of this unified and hardened part can be difficult or impossible, particularly if damage occurs in the portion where the identifying information has been engraved.

SUMMARY OF INVENTION

The present invention provides a firearm noise suppressor and method of manufacture that allows repair or replacement of all structural parts without defacement of the required engraved identifying information.

A baffle chamber unit is provided, having an outer surface. An identification band with identifying indicia is placed on the baffle chamber unit and a specified area of the band not having identifying indicia is affixed to the baffle chamber unit to prevent the removal of the band without a machining process. For example, a specified area of the band may be deformed into a dimpled recess in the outer surface of the baffle chamber unit (or otherwise semi-permanently attached at a localized area). Thus, the band can be removed by an authorized (licensed) person and re-attached to a repaired or replaced baffle chamber unit without altering or defacing the engraved identifying information.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
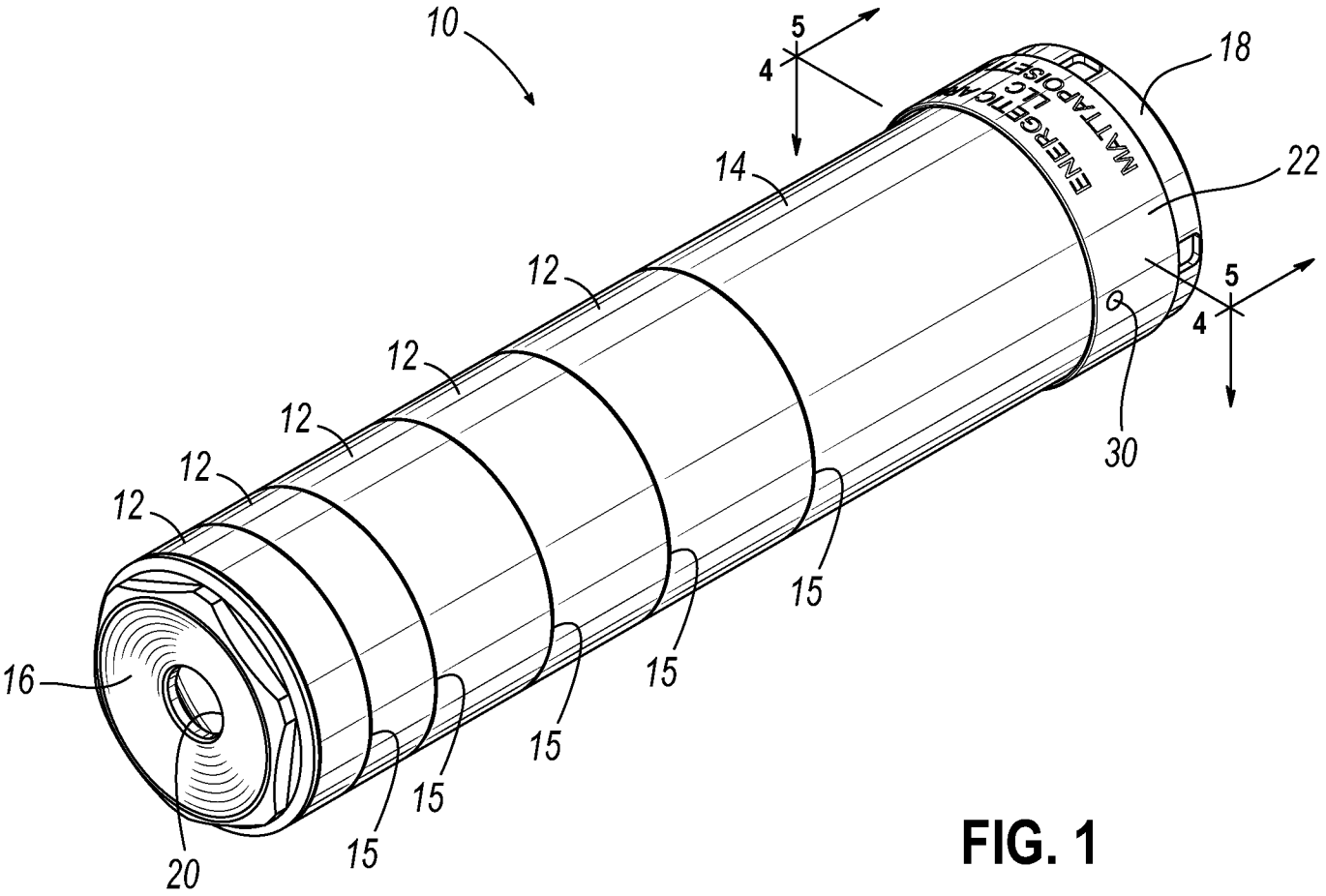
FIG. 1 is an isometric view of a firearm noise suppressor constructed according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
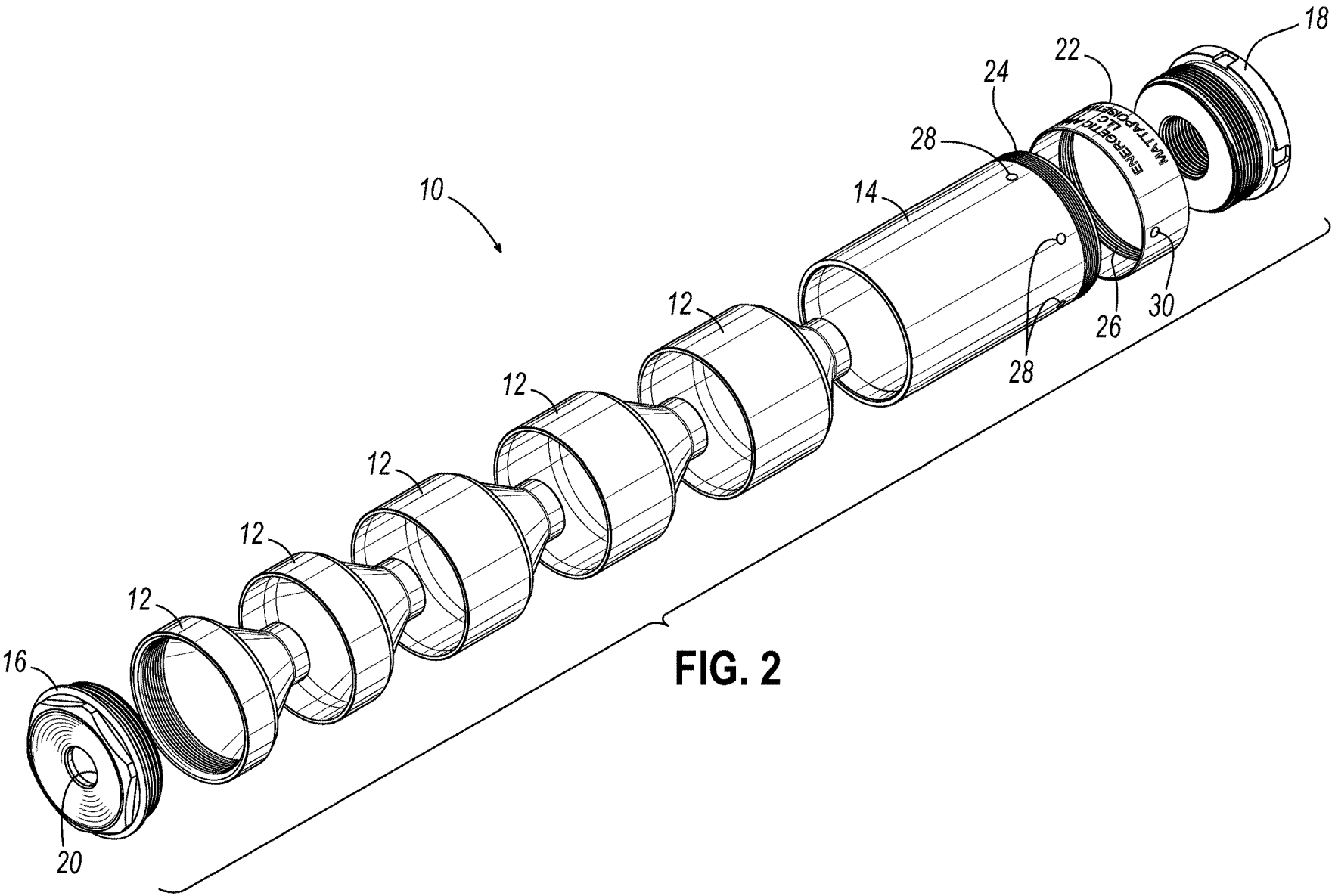
FIG. 2 is an exploded isometric view of the parts thereof.
Figure 3:
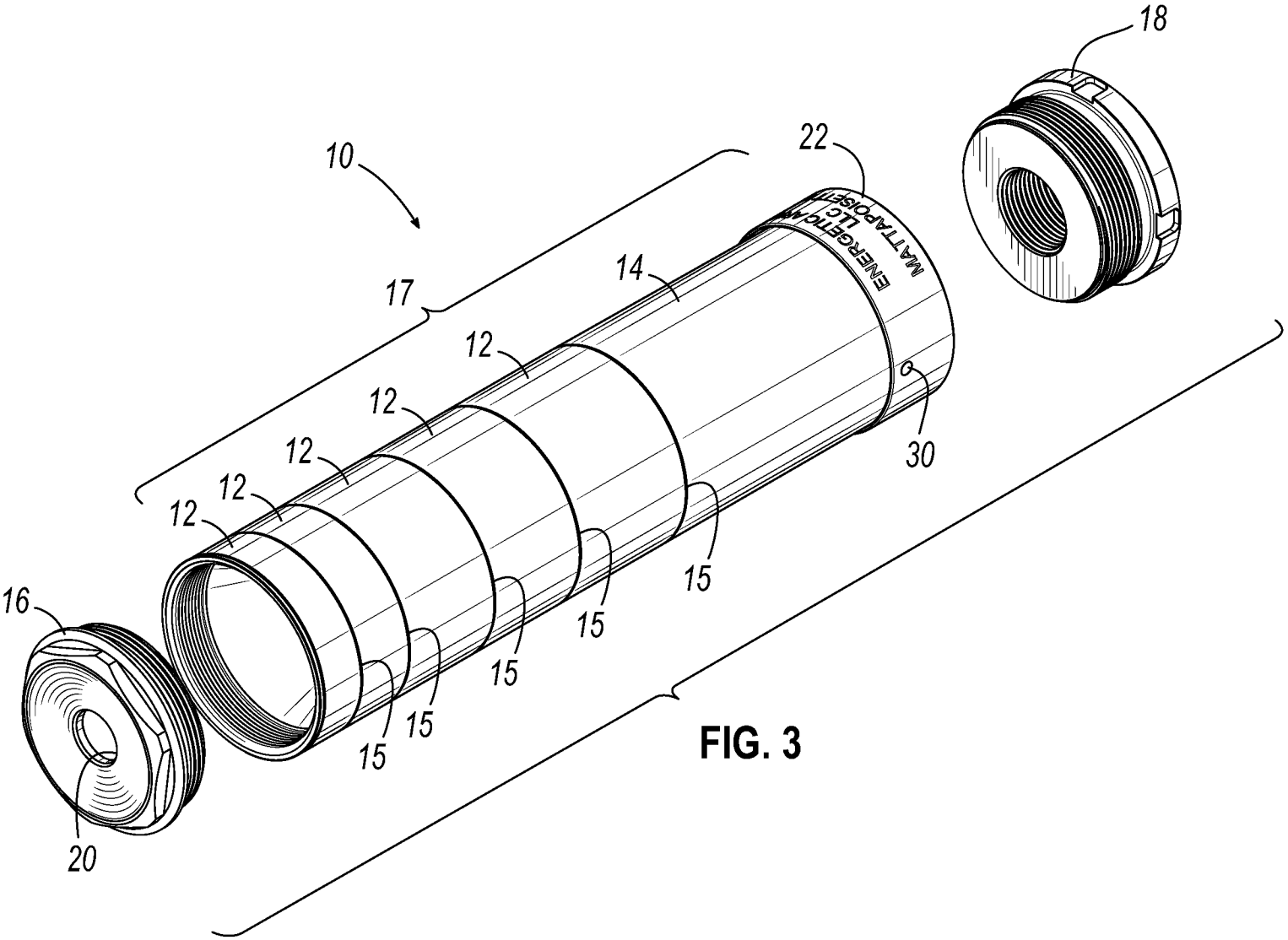
FIG. 3 is an isometric view showing the unified baffles with end caps separated therefrom.

Referring first to FIGS. 1-3, therein is shown a suppressor 10 according to one embodiment of the present invention. The body of the suppressor 10 provides a series of individual baffle units unified to define interior pressure chambers. In the illustrated embodiment, a series of baffles 12 and a blast chamber 14 are permanently attached together, such as by circumferential welding at joints 15, to form a baffle chamber unit 17. The specific shape and style of the baffle walls are not important to this invention. They can be, for example, a series of "M" baffles, cone baffles with spacers, or, as illustrated, cone baffles 12 with integrated spacers. The baffles 12 and blast chamber 14 can be fused together and heat treated as a unit to create a high-strength pressure chamber at minimized weight and without the need for an exterior tubular housing. In the illustrated embodiment, the front end cap 16 and rear mounting end cap 18 may be removably attached to the baffle unit, such as by threads. In this manner, the rear mounting end cap 18 may be user-exchanged with one providing a different threaded or other engagement means for attachment to the muzzle of a firearm barrel (not shown). The front end cap 16 may be user-replaced to provide an end opening 20 for a selected caliber. Alternatively, the end caps 16, 18 may be permanently fixed to or unitary with the baffle core.

According to one embodiment of the invention, an identification band 22 may be provided that is semi-permanently affixed to the baffle chamber unit 17. The band 22 is engraved with all required identifying information and is sized to closely fit over a portion of the baffle chamber unit 17, such as at or adjacent to the proximal (rear) end of the blast chamber 14. An outer surface of the blast chamber 14 (or a baffle unit 12) may be provided with relatively fine exterior threads 24 that will mate with threads 26 on the interior of the identification band 22. Adjacent to the exterior threads 24 may be one or more recesses or dimples 28 that are covered by the identification band 22 when it is installed. If desired, a high temperature thread-locking adhesive, such as Loctite™ or Rocksett™, may be applied to the treads. Alternatively, the band 22 may be induction shrink fit in place. The band may be made of the same material as the baffle chamber unit 17 or may be a different material. It is contemplated that the materials would be metal alloys, but the development of composite materials and additive manufacturing may make the construction and method of the present invention adaptable to suppressors made from such materials.

Figure 4:
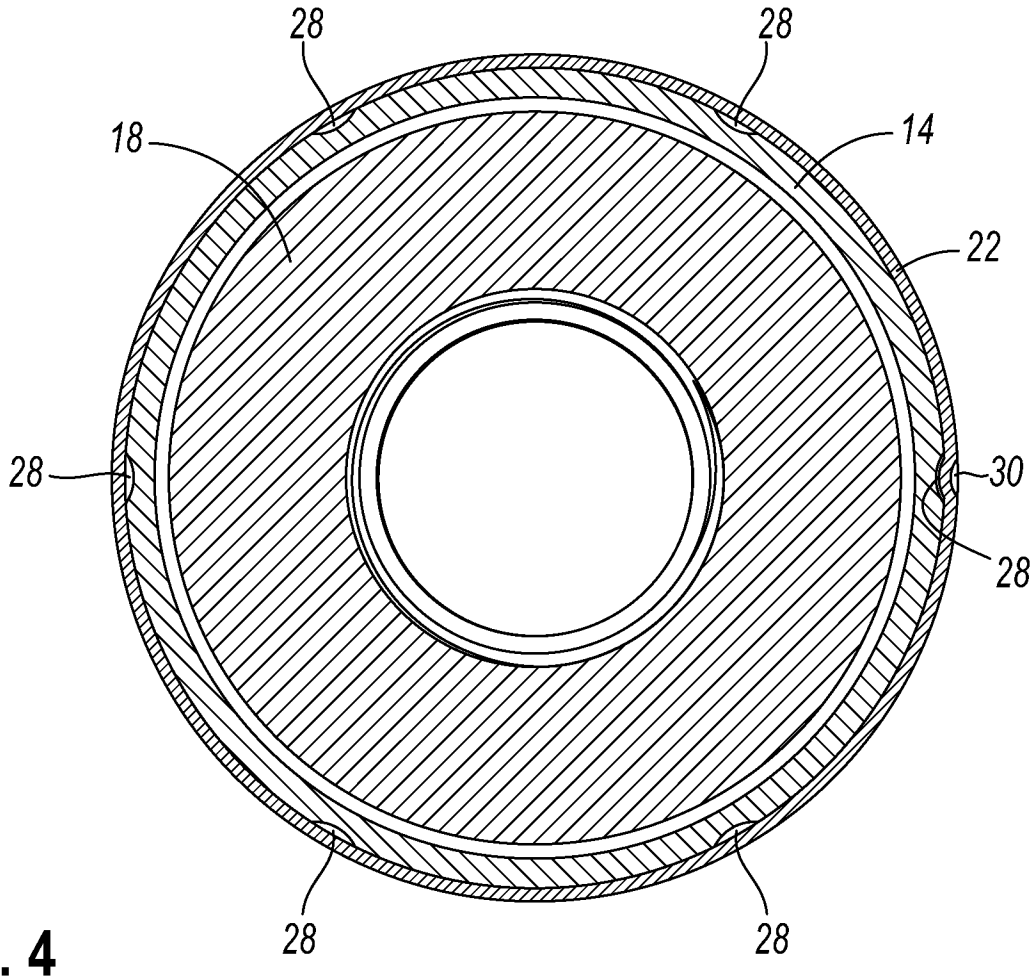
FIG. 4 is a cross sectional view taken substantially along line 4-4 of FIG. 1; and, FIG. 5 is a partial cross-sectional view taken substantially along line 5-5 of FIG. 1.
Figure 5:
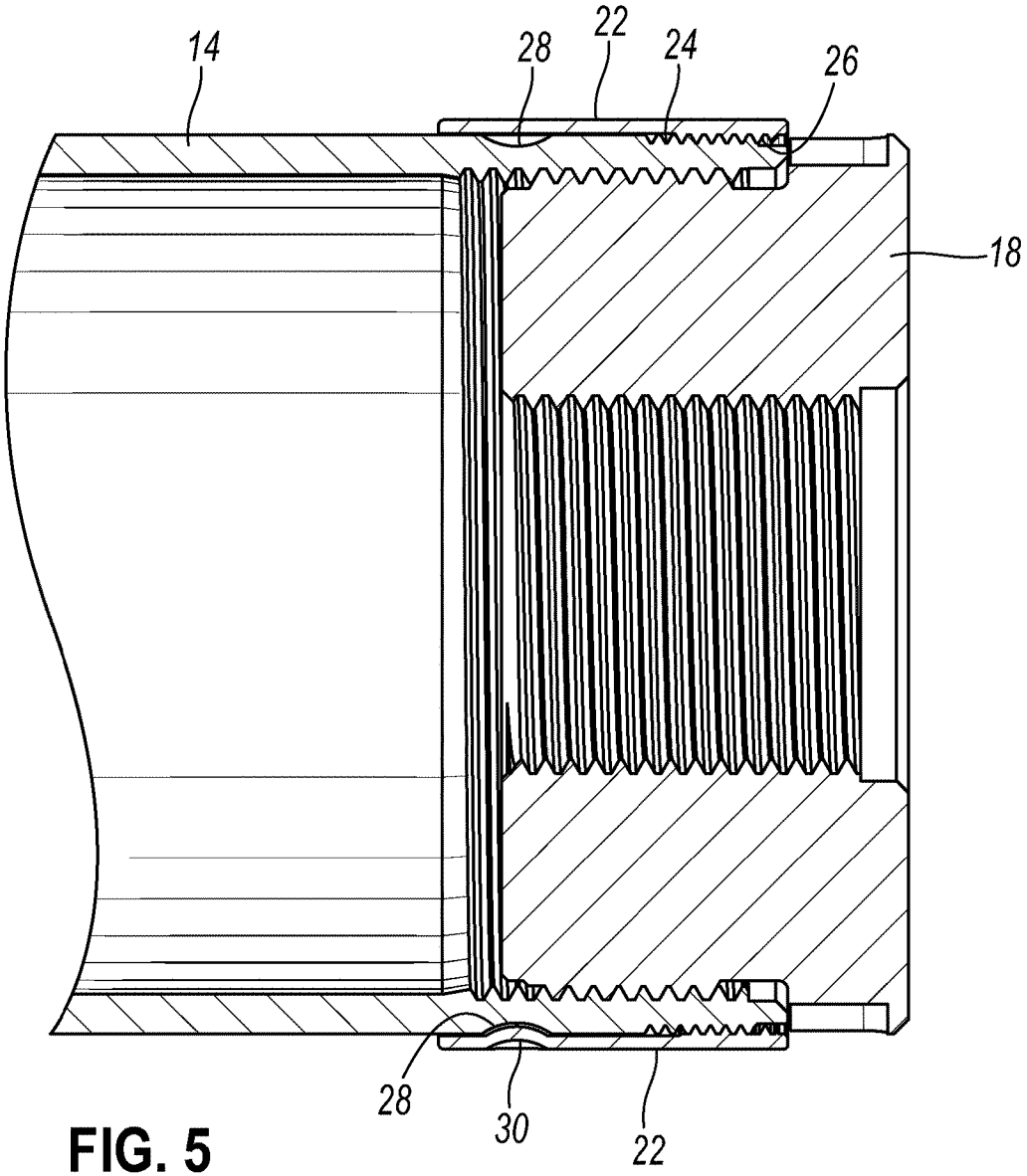

As illustrated in FIGS. 4 and 5, after the identification band 22 is threaded into position, a selected area/spot 30 on the band 22 is staked, swaged, or otherwise deformed into the recess of one of the dimples 28. Thus, the band 22 cannot be removed from the suppressor body without some machining process, such as drilling out the deformed area 30 so that it can be unthreaded for removal. This drilling provides an obvious indication that the band has been removed that is difficult to conceal. The drilled hole may provide an anchor point for the attachment of a spanner to facilitate unthreading.

An area 30 for deformation is selected that will not alter, interfere with, or deface the identifying indicia engraved on the band 22. This may be accomplished, for example, by locating the deformation area(s) 30 adjacent an edge of the band 22 and the indicia away from that edge. Thus, a plurality of dimples 28 may be provided at spaced intervals around the circumference of the baffle chamber unit 17 (such as blast chamber 14) carrying the identification band 22. Locator indicia (not shown) could be provided on the unit 17 to indicate the location of dimples 28 when the band 22 is covering them. Likewise, if the deformed area 30 of the band 22 is drilled or otherwise machined for removal so that the underlying part can be repaired or replaced, the band 22 can be re-attached by staking or swaging a different location on the band 22 into a dimple 28 at a different location on the baffle chamber unit 17.

Other methods of affixing the band 22 to the baffle chamber unit 17 by may be used to make a localized semi-permanent attachment, such as resistance or tack (spot) welds (not shown). These could be drilled or machined away to allow removal of the band 22 without defacing or altering the engraved informational indicia but would provide a similar obvious indication of removal and allow reattachment by welding at a different localized area of the band.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the claim or claims of a patent issued hereon.

What is claimed is:

1. A method of repairing a firearm noise suppressor that includes a baffle chamber unit defining a plurality of separated interior chambers and having a length and an a substantially imperforate outer wall surface, the interior chambers separated by at least one interior baffle wall with a central opening configured to allow passage of a projectile, a removable identification band with identifying indicia thereon and fitted on at least a portion but less than the entire length of the outer wall surface of the baffle chamber unit with material of a selected area of the band is affixed to the baffle chamber unit to prevent the removal of the band without a machining process to the selected area, the method comprising the steps of:

machining the affixed area of the band to remove the affixed material;

removing the band from the baffle chamber unit;

repairing or preplacing the baffle chamber unit;

reinstalling the band on the baffle chamber unit;

affixing a different area of the band to the baffle chamber unit to prevent the removal of the band without a machining process.

2. The method of claim 1, wherein the selected area of the band that is affixed does not include identifying indicia.

3. The method of claim 1, wherein the baffle chamber unit has at least one dimpled recess on the outer surface and the band is placed over the at least one dimpled recess, the band being affixed by deforming the selected area of the band to protrude into the dimpled recess.

4. The method of claim 3, further comprising:

providing corresponding threads on the outer surface of the baffle chamber unit adjacent the at least one dimpled recess and on an inside surface of the identification band, and threading the band onto the baffle chamber unit before deforming the selected area of the band into the dimpled recess.

5. The method of claim 4, further comprising the addition of a thread-locking adhesive on at least one of the threaded surfaces before threading the band onto the baffle chamber unit.

6. The method of claim 3, further comprising providing a plurality of dimpled recesses on the outer surface of the baffle chamber unit.

* * * * *